US006866727B1

(12) United States Patent
Hieber et al.

(10) Patent No.: US 6,866,727 B1
(45) **Date of Patent: *Mar. 15, 2005**

(54) HIGH TEMPERATURE POWDER METALLURGY SUPERALLOY WITH ENHANCED FATIGUE AND CREEP RESISTANCE

(75) Inventors: Andrew F. Hieber, Scottsdale, AZ (US); Howard F. Merrick, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/741,979

(22) Filed: Dec. 19, 2003

Related U.S. Application Data

(63) Continuation-in-part of application No. 10/651,480, filed on Aug. 29, 2003.

(51) Int. Cl.[7] ..... C22C 19/05

(52) U.S. Cl. ..... 148/428; 420/448; 420/450; 420/449

(58) Field of Search ..... 420/448, 449, 420/450; 148/428

(56) References Cited

U.S. PATENT DOCUMENTS

| | | | | | |
|---|---|---|---|---|---|
| 5,393,483 | A | * | 2/1995 | Chang | 419/10 |
| 5,395,584 | A | * | 3/1995 | Berger et al. | 420/443 |
| 5,938,863 | A | * | 8/1999 | Malley | 148/428 |
| 6,106,767 | A | * | 8/2000 | Kennedy et al. | 420/448 |
| 6,468,368 | B1 | * | 10/2002 | Merrick et al. | 148/428 |
| 6,521,175 | B1 | * | 2/2003 | Mourer et al. | 420/448 |

FOREIGN PATENT DOCUMENTS

| | | | | |
|---|---|---|---|---|
| GB | 2071695 A | * | 9/1981 | |
| JP | 55-82738 | * | 6/1980 | 420/448 |
| JP | 3-197653 | * | 8/1991 | 148/428 |

* cited by examiner

*Primary Examiner*—John P. Sheehan
(74) *Attorney, Agent, or Firm*—Robert Desmond, Esq.

(57) ABSTRACT

A nickel based superalloy composition comprising about 16.5 to about 20.5 weight % Co, about 9.5 to about 12.5 weight % Cr, about 1.8 to about 3.2 weight % Mo, about 4.25 to about 6.0 weight % W, about 3.0 to about 4.2 weight % Al, about 3.0 to about 4.4 weight % Ti, about 1.0 to about 2.0 weight % Ta, about 0.6 to about 1.8 weight % Nb, about 0.01 to about 0.08 weight % C, about 0.01 to about 0.06 weight % B, and about 0.04 to about 0.15 weight % Zr, balance Ni.

23 Claims, 3 Drawing Sheets

HIGH TEMPERATURE POWDER METALLURGY SUPERALLOY WITH ENHANCED FATIGUE AND CREEP RESISTANCE

CROSS REFERENCE TO RELATED APPLICATIONS

This application is a continuation-in-part Application of U.S. application Ser. No. 10/651,480, filed Aug. 29, 2003, the entire contents of which are hereby incorporated by reference.

BACKGROUND OF THE INVENTION

The present invention generally relates to a nickel based superalloy composition. The present invention also relates to a component comprising a nickel based superalloy composition.

Nickel based superalloys have been extensively used in manufacturing gas turbine engine components. Gas turbine engines having hotter exhaust gases and which operate at higher temperatures are more efficient. To maximize the efficiency of gas turbine engines, attempts have been made to form gas turbine engine components, such as turbine discs, having higher operating temperature capabilities. In particular, there is considerable commercial interest in superalloys for turbine and compressor disk applications which exhibit strength and creep resistance at relatively high temperatures (e.g., 1300–1500° F.), as well as resistance to fatigue crack initiation at the lower temperatures (e.g., 500–1100° F.) often experienced in compressor and turbine disk bores. Higher temperature dwell crack growth resistance is also a significant parameter.

The previous generation of higher temperature capability disk alloys of the prior art are limited to about 1200–1300° F. operating temperature, and include such commercially used alloys as P/M Astroloy, Rene' 88 DT, and IN100. Such disk alloys, including the most recent generation of alloys, are typically made by inert gas atomization into powder form. The powder is subsequently screened to an appropriate size range and consolidated by hot compaction or by hot isostatic pressing (HIP). The consolidated powder is then extruded into a form suitable for isothermal forging into a shape that can be machined into an engine component. Components may also be formed by hot isostatic pressing (HIP) without the extrusion and isothermal forging steps, and subsequently machined to final shape. These methods of manufacture are common throughout the industry for high gamma prime volume fraction disk alloys.

U.S. Pat. No. 6,521,175 B1 to Mourer, et al. discloses a nickel based superalloy which contains 1.9 to 4.0 wt. % tungsten. The superalloy of Mourer, et al. sacrifices some low-temperature dwell fatigue crack growth performance to achieve improved creep performance.

As can be seen, there is a need for a nickel based superalloy composition which exhibits enhanced fatigue crack initiation life at temperatures of 500 to 1200° F., as well as enhanced resistance to creep at temperatures of 1200 to 1500° F. Dwell crack growth resistance at these higher temperatures (1200 to 1500° F.) is also of importance.

SUMMARY OF THE INVENTION

In one aspect of the present invention, there is provided a nickel based superalloy composition, comprising: Ni, Co, Cr, Mo, W, Al, Ti, Ta, Nb, C, B, and Zr, wherein W is present in an amount greater than 4 weight %.

In another aspect of the present invention, there is provided a nickel based superalloy composition, comprising about 16.5 to about 20.5 weight % Co, about 9.5 to about 12.5 weight % Cr, about 1.8 to about 3.2 weight % Mo, about 4.25 to about 6.0 weight % W, about 3.0 to about 4.2 weight % Al, about 3.0 to about 4.4 weight % Ti, about 1.0 to about 2.0 weight % Ta, about 0.6 to about 1.8 weight % Nb, about 0.01 to about 0.08 weight % C, about 0.01 to about 0.06 weight % B, and about 0.03 to about 0.15 weight % Zr, balance Ni.

In still another aspect of the present invention, there is provided a nickel based superalloy composition, comprising about 16.8 to about 19.8 weight % Co, about 10.0 to about 12 weight % Cr, about 2.2 to about 3.0 weight % Mo, about 4.25 to about 5.5 weight % W, about 3.3 to about 3.9 weight % Al, about 3.3 to about 4.1 weight % Ti, about 1.30 to about 1.80 weight % Ta, about 0.80 to about 1.60 weight % Nb, about 0.02 to about 0.05 weight % C, about 0.02 to about 0.05 weight % B, and about 0.04 to about 0.12 weight % Zr, balance Ni.

In a further aspect of the present invention, there is provided a nickel based superalloy composition, comprising about 17.8 to about 19.8 weight % Co, about 10.0 to about 12.0 weight % Cr, about 2.3 to about 2.9 weight % Mo, about 4.25 to about 5.0 weight % W, about 3.3 to about 3.8 weight % Al, about 3.5 to about 4.0 weight % Ti, about 1.3 to about 1.8 weight % Ta, about 0.90 to about 1.6 weight % Nb, about 0.02 to about 0.05 weight % C, about 0.020 to about 0.040 weight % B, and about 0.05 to about 0.10 weight % Zr, balance Ni.

In still a further aspect of the present invention, there is provided a nickel based superalloy composition, comprising about 16.8 to about 17.2 weight % Co, about 10.5 to about 12 weight % Cr, about 2.4 to about 2.8 weight % Mo, about 5.1 to about 5.5 weight % W, about 3.4 to about 3.8 weight % Al, about 3.6 to about 4.0 weight % Ti, about 1.3 to about 1.7 weight % Ta, about 0.80 to about 1.40 weight % Nb, about 0.02 to about 0.05 weight % C, about 0.020 to about 0.040 weight % B, and about 0.05 to about 0.10 weight % Zr, balance Ni.

In yet another aspect of the present invention, there is provided a nickel based superalloy composition, comprising about 16.8 to about 19.8 weight % Co, about 10.0 to about 12.0 weight % Cr, about 2.2 to about 3.0 weight % Mo, about 4.25 to about 5.5 weight % W, about 3.3 to about 3.9 weight % Al, about 3.3 to about 4.1 weight % Ti, about 1.3 to about 1.8 weight % Ta, about 0.80 to about 1.60 weight % Nb, about 0.02 to about 0.05 weight % C, about 0.02 to about 0.05 weight % B, and about 0.04 to about 0.12 weight % Zr, balance Ni, wherein said superalloy has a LCF life at 1100° F., R=0, 0.7% strain greater than about 200,000 cycles, and a time for 0.2% creep at 1300° F. and 100 ksi greater than about 400 hours.

These and other features, aspects and advantages of the present invention will become better understood with reference to the following drawings, description and claims.

DETAILED DESCRIPTION OF THE INVENTION

Figure 1A:
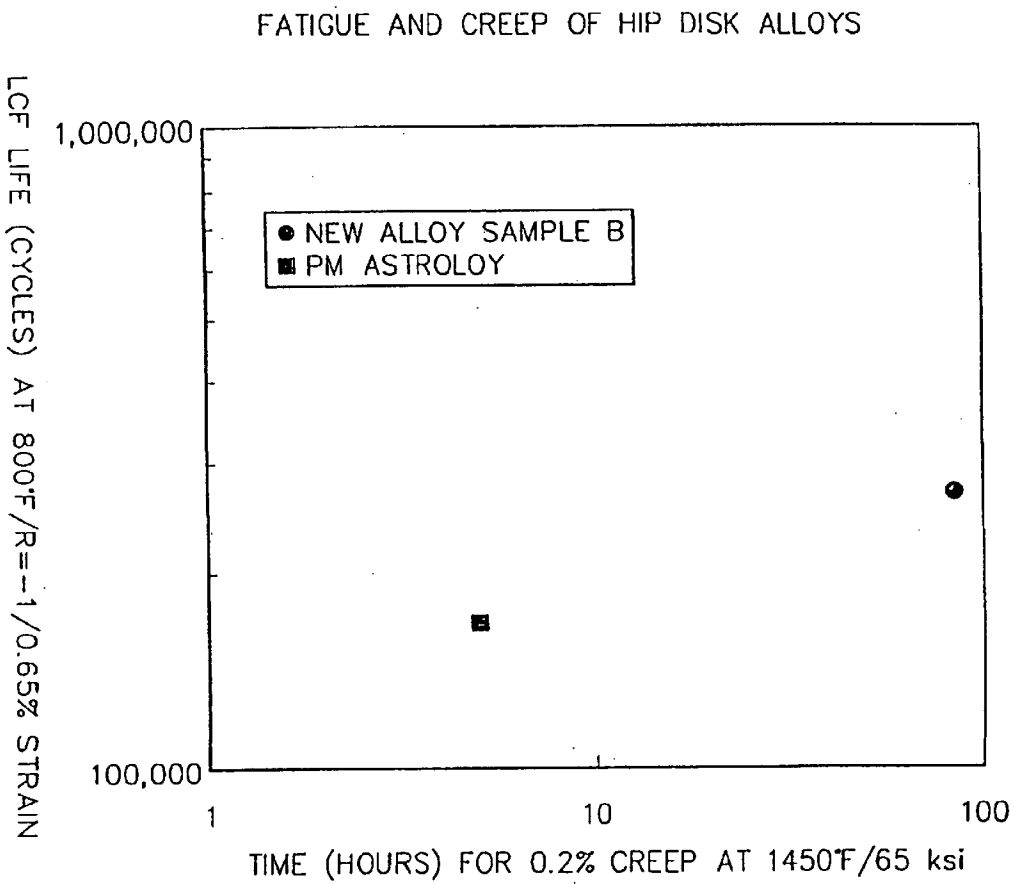
FIG. 1A is a plot showing 0.2% creep and low cycle fatigue (0.65% strain) data for alloy sample B of the invention and for a conventional alloy (Astroloy)

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides nickel based superalloy compositions useful for forming components for gas turbine engines, such as compressor disks, turbine disks, disk seal plates and spacers. The superalloy compositions of the present invention differ from prior art nickel based superalloys (see, e.g., U.S. Pat. No. 6,521,175 B1 to Mourer, et al.) in that alloys of the invention, inter alia, contain tungsten (W) at concentrations greater than 4.0% by weight, and typically have a W content equal to or greater than about 4.25% by weight.

Compositions of the present invention exhibit fatigue crack initiation life at intermediate temperatures (500 to 1200° F.) that are higher by about an order of magnitude as compared with previously disclosed superalloy compositions. Alloys of the present invention have superior low cycle fatigue (LCF) properties as compared with previously disclosed nickel based superalloys. For example, alloys of the present invention may have LCF life in excess of 470,000 cycles at 1100° F. and 0.7% strain. Additionally, compositions of the present invention have superior dwell crack growth resistance at higher temperatures (1200 to 1500° F.), as compared with the current compositions U720 and Astroloy. Alloys of the present invention may exhibit 0.2% creep values greater than about 400 hours at 1300° F. and 100 ksi, and greater than about 50 hours at 1450° F., and 65 ksi.

Alloy compositions of the present invention may be suitable for forming gas turbine engine components, such as turbine discs and exhibit resistance to the formation of harmful constituents such as sigma phase when exposed to high temperatures (1300° F.+) for long periods of time. This latter property is commonly known in the art as "stability". Compositions are selected within the broad range based on proprietary calculations that predict metallurgical stability. Alloy compositions of the present invention enable turbine disk rim operating temperatures in excess of 1400° F., while providing a level of fatigue crack initiation resistance at disk bore temperatures (typically 500 to 1100° F.) at least equivalent to the highest known level of fatigue crack initiation resistance attainable in previously disclosed alloys having much lower high temperature capability as compared with alloys of the invention.

Commonly assigned U.S. Pat. No. 6,468,368 B1 to Merrick, et al., and commonly assigned U.S. patent Application Publication No. 2003/0079809 Al also to Merrick, et al. disclose a nickel based superalloy which contains 4.5 to 7.5 weight % (tungsten+rhenium), the disclosures of which are incorporated by reference herein in their entirety for all purposes.

Alloy compositions disclosed by Merrick et al. (U.S. Pat. No. 6,468,368) exhibit strength and creep resistance as well as stability at high temperatures (e.g., 1200 to 1500° F.) (see data for the sample designated as Alloy 1, FIGS. 1B–C). As will be appreciated, nickel based superalloys which have similar, or the same, components may have markedly different and unexpected properties according to the proportion of the various components. For example, the proportion of alloy components such as W, Nb, Mo, Co, and Ta can have a major impact on the strength, creep resistance, and crack initiation resistance of the alloy. Applicants have now identified compositions having superior crack growth and creep resistance at higher temperatures (1200 to 1500° F.), and a high level of fatigue crack initiation resistance at disk bore temperatures (typically 500 to 1100° F.), as compared with previously disclosed compositions.

Superalloy compositions of the present invention may be produced by inert gas atomization, and consolidated by hot isostatic pressing (HIP), or hot compaction. The material can be used in HIP form, or may be extruded for forging stock to make isothermally forged turbine engine disks or other components. Such production processes are well known in the art.

In one embodiment of the invention, a nickel based superalloy composition may comprise Ni, Co, Cr, Mo, W, Al, Ti, Ta, Nb, C, B, and Zr, wherein W is greater than 4 weight %. More particularly, the nickel based superalloy composition may comprise from about 16.5 to about 20.5 weight % Co, about. 9.5 to about 12.5 weight % Cr, about 1.8 to about 3.2 weight % Mo, about 4.25 to about 6.0 weight % W, about 3.0 to about 4.2 weight % Al, about 3.0 to about 4.4 weight % Ti, about 1.0 to about 2.0 weight % Ta, about 0.06 to about 1.8 weight % Nb, about 0.01 to about 0.08 weight % C, about 0.01 to about 0.06 weight % B, and about 0.03 to about 0.15 weight % Zr, balance Ni.

In an exemplary embodiment of the invention, the nickel based superalloy composition comprises from about 16.8 to about 19.8 weight % Co, about 10.0 to about 12.0 weight % Cr, about 2.2 to about 3.0 weight % Mo, about 4.25 to about 5.5 weight % W, about 3.3 to about 3.9 weight % Al, about 3.3 to about 4.1 weight % Ti, about 1.30 to about 1.8 weight % Ta, about 0.80 to about 1.60 weight % Nb, about 0.02 to about 0.05 weight % C, about 0.02 to about 0.05 weight % B, and about 0.05 to about 0.12 weight % Zr, balance Ni.

In a first more preferred embodiment of the invention a nickel based superalloy composition, which may be designated Alloy 1.1, comprises from about 17.8 to about 19.8 weight % Co, about 10.0 to about 12.0 weight % Cr, about 2.3 to about 2.9 weight % Mo, about 4.25 to about 5.0 weight % W, about 3.3 to about 3.8 weight % Al, about 3.5 to about 4.0 weight % Ti, about 1.3 to about 1.8 weight % Ta, about 0.90 to about 1.60 weight % Nb, about 0.02 to about 0.050 weight % C, about 0.02 to about 0.040 weight % B, and about 0.05 to about 0.10 weight % Zr, balance Ni. The nickel based superalloy composition designated Alloy 1.1 may exhibit a LCF life at 800° F., R=−1, 0.65% strain, of greater than about 260,000 cycles.

EXAMPLE 1

As an example of Alloy 1.1, the nickel based superalloy composition includes about 18.5 weight % Co, about 11 weight % Cr, about 3.55 weight % Al, about 2.6 weight % Mo, about 4.6 weight % W, about 3.75 weight % Ti, about 1.5 weight % Ta, about 0.90 to about 1.60 weight % Nb, about 0.03 weight % C, about 0.03 weight % B, and about 0.075 weight % Zr, balance Ni. For this alloy (1.1), it is of importance to note that Co content may be increased to levels as high as about 20% in order to reduce solvus temperature without adversely affecting stability and properties. The mean Co content of such a reduced solvus version of Alloy 1.1 may be about 19.25. Reduced solvus temperature may be useful for improving ease of processing for certain applications.

In a second more preferred embodiment of the invention, which may be designated Alloy 1.2, a nickel based superalloy composition comprises from about 16.8 to about 17.2 weight % Co, about 10.5 to about 12 weight % Cr, about 2.4 to about 2.8 weight % Mo, about 5.1 to about 5.5 weight % W, about 3.4 to about 3.8 weight % Al, about 3.6 to about 4.0 weight % Ti, about 1.3 to about 1.7 weight % Ta, about 0.85 to about 1.15 weight % Nb, about 0.02 to about 0.05 weight % C, about 0.020 to about 0.040 weight % B, and about 0.05 to about 0.10 weight % Zr, balance Ni. This embodiment is less preferred than the first preferred embodiment. The nickel based superalloy composition designated Alloy 1.2 may exhibit a LCF life at 1100° F., R=0, 0.7% strain, of greater than about 470,000 cycles. Alloy 1.2 may further exhibit a time for 0.2% creep, at 1300° F. and 100 ksi, of greater than about 400 hours, in fine grain form.

EXAMPLE 2

As an example of Alloy 1.2, the nickel based superalloy composition includes about 17 weight % Co, about 11.25 weight % Cr, about 3.6 weight % Al, about 2.55 weight % Mo, about 5.3 weight % W, about 3.8 weight % Ti, about 1.5 weight % Ta, about 1.0 weight % Nb, about 0.03 weight % C, about 0.03 weight % B, and about 0.075 weight % Zr, balance Ni.

The embodiment of the invention generally corresponding to Alloy 1.1 has the characteristics of ease of producibility, and has a reduced solvus temperature, due to increased Co content, as compared with Alloy 1.2. Alloy 1.2 may have increased high temperature creep and crack growth resistance capability, as compared with Alloy 1.1. In light of the differences in properties and composition of Alloy 1.1 (e.g., Sample B, Alloy 1.1B) in comparison with that of Alloy 1.2 (e.g., Sample C, Alloy 1.2C), one skilled in the art may recognize how to formulate compositions exhibiting variations of such properties. The composition and performance characteristics of a nickel based superalloy designated Sample D (Alloy 1.3), which is intermediate between Alloy 1.1 and Alloy 1.2 with respect to its content of C, Cr, Co, Nb, Al, and B, is described in Example 3, according to one embodiment of the invention.

An alloy having a composition intermediate between those of Alloys 1.1 and 1.2 (e.g., Alloy 1.3 (Example 3)) may comprise about 17.4 weight % Co, about 11.0 weight % Cr, about 2.56 weight % Mo, about 5.5 weight % W, about 3.64 weight % Al, about 3.8 weight % Ti, about 1.47 weight % Ta, about 0.94 weight % Nb, about 0.03 weight % C, about 0.03 weight % B, and about 0.1 weight % Zr, balance Ni. A superalloy such as Alloy 1.3 may exhibit a LCF life, at 1100° F. and 0.7% strain, of greater than about 200,000 cycles.

In one embodiment, nickel based superalloy compositions of the present invention may be formed by the Powder Metallurgy (P/M) route, for example, as described in commonly assigned U.S. Pat. No. 6,468,368 B1 to Merrick, et al., the disclosure of which is incorporated by reference herein in its entirety for all purposes.

In some embodiments, nickel based superalloy compositions of the present invention may optionally further include rhenium in an amount from 0 to about 2.0 weight %, and usually at or near 0 weight %. Generally, rhenium may have little or no effect on superalloy properties, but may result in a slight enhancement of creep performance.

In some embodiments, nickel based superalloy compositions of the present invention may optionally further include hafnium in an amount from 0 to about 1.0 weight %, although amounts greater than 0% may have a negative impact on LCF properties, as seen in some prior art superalloys. Additional elements, such as magnesium (up to 0.1 weight %), may also be added to superalloy compositions of the invention, typically with no substantial effect on properties.

EXAMPLE 3

An alloy of the invention designated Sample B (Alloy 1.1B) was prepared having the following composition expressed as weight %: about 18.2% Co, about 11.2% Cr, about 2.65% Mo, about 4.8% W, about 3.57% Al, about 3.86% Ti, about 1.65% Ta, about 0.95% Nb, about 0.027% C, about 0.028% B, and about 0.07% Zr, balance Ni. A conventional alloy (Astroloy) was also prepared, and the fatigue and creep characteristics of HIP processed Sample B and Astroloy were compared. For both the Astroloy and Sample B alloy, 270 mesh powder was used. Both the Astroloy and Sample B were supersolvus HIP processed at about 2215° F., and solution treated to yield a grain size of ASTM 7 to 8. The cooling rate was about 75° F. per minute from solution treatment temperature for both Astroloy and Sample B.

The data for LCF life at 800° F., R=−1, 0.65% strain, and time for 0.2 % creep at 1450° F., 65 ksi for conventional Astroloy and Sample B of the invention are shown in FIG. 1A. Under these conditions the conventional material, Astroloy, bad a LCF of 166,810 cycles. In comparison, Sample B (Alloy 1.1B) of the invention had a LCF of 266,154 cycles. Similarly, the conventional material, Astroloy, showed a time for 0.2% creep at 1450° F. and 65 ksi of five (5) hours. In comparison, Sample B (Alloy 1.1B) of the invention exhibited a time for 0.2% creep at 1450° F. and 65 ksi of 85 hours. The data from FIG. 1A is tabulated below (Table 1).

TABLE 1

LCF and 0.2% Creep Values for Sample B and PM Astroloy

| Alloy Material | Time (hours) for 0.2% Creep (1450° F., 65 ksi) | LCF Life (cycles) (800° F., R = −1, 0.65% strain) |
|---|---|---|
| Sample B | 85 | 266,154 |
| PM Astroloy[1] | 5 | 166,810 |

[1]conventional superalloy

EXAMPLE 4

An alloy of the invention designated Sample A (Alloy 1.1A) was prepared having the following composition expressed as weight %: about 17.8% Co, about 11.0% Cr, about 2.6% Mo, about 5.0% W, about 3.58% Al, about 3.9 % Ti, about 1.47% Ta, about 1.03% Nb, about 0.028% C, about 0.028% B, and about 0.10% Zr, balance Ni. The fatigue and creep characteristics of HIP processed Sample A were generally similar to those of HIP processed Sample B as described hereinabove (Example 3 and FIG. 1A).

EXAMPLE 5

An alloy of the invention designated Sample C (Alloy 1.2C) was prepared having the following composition expressed as weight %: about 16.9% Co, about 11.1% Cr, about 2.55% Mo, about 5.5% W, about 3.79% Al, about 3.97% Ti, about 1.57% Ta, about 0.91% Nb, about 0.033% C, about 0.035% B, and about 0.09% Zr, balance Ni. Sample C was made from 270 mesh powder, hot compacted, extruded, and isothermally forged. The test material was subsolvus solution treated to yield a grain size of ASTM 11–12. The cooling rate from solution temperature was about 130° F. per minute.

EXAMPLE 6

A further alloy of the invention, designated Sample D (Alloy 1.3), was prepared having the following composition expressed as weight %: about 17.4 % Co, about 11.0% Cr, about 2.56% Mo, about 5.5% W, about 3.64% Al, about 3.8% Ti, about 1.47% Ta, about 0.94% Nb, about 0.03% C, about 0.03% B, and about 0.1% Zr, balance Ni. Sample D was made from 270 mesh powder, hot compacted, extruded and isothermally forged. The solution treatment was subsolvus to yield a grain size of ASTM 10–11. The cooling rate from solution temperature was about 500° F. per minute.

Figure 1B:
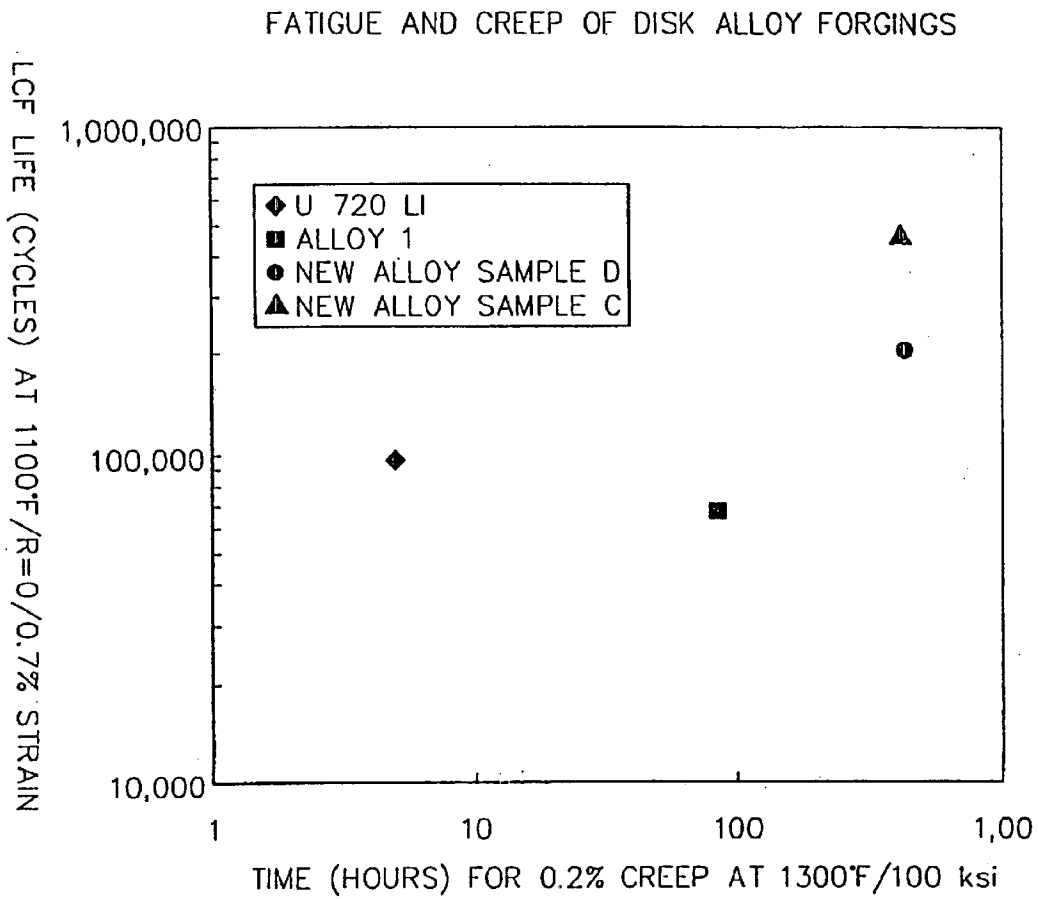
FIG. 1B is a plot showing 0.2% creep and low cycle fatigue (0.7% strain) data for alloy samples C and D of the invention and for conventional alloy U720 LI.

The data for low cycle fatigue (LCF) life at 1100° F., R=0, 0.7% strain, and time for 0.2% creep at 1300° F., 100 ksi, for Samples C and D of the invention are shown in FIG. 1B. For comparison, conventional alloy U720 LI was tested under the same conditions. Alloy 1 represents an alloy composition according to commonly assigned U.S. Pat. No. 6,468,368 B1 to Merrick et al. Samples C and D of the invention had a LCF life of 472,876 cycles and 205,610 cycles, respectively; and a time for 0.2% creep at 1300° F. and 100 ksi of 432 hours and 450 hours, respectively.

Under these conditions, LCF values for Samples C and D, respectively, are almost five times (5×) and more than twice (>2×) the LCF value for conventional alloy U720 LI. Time for 0.2% creep for Samples C and D of the invention is about two (2) orders of magnitude greater than that for conventional alloy 720. It can also be seen from FIG. 1B that under the specified test conditions, LCF values and time for 0.2% creep for Samples C and D are at least several fold higher than those for Alloy 1.

Figure 1C:
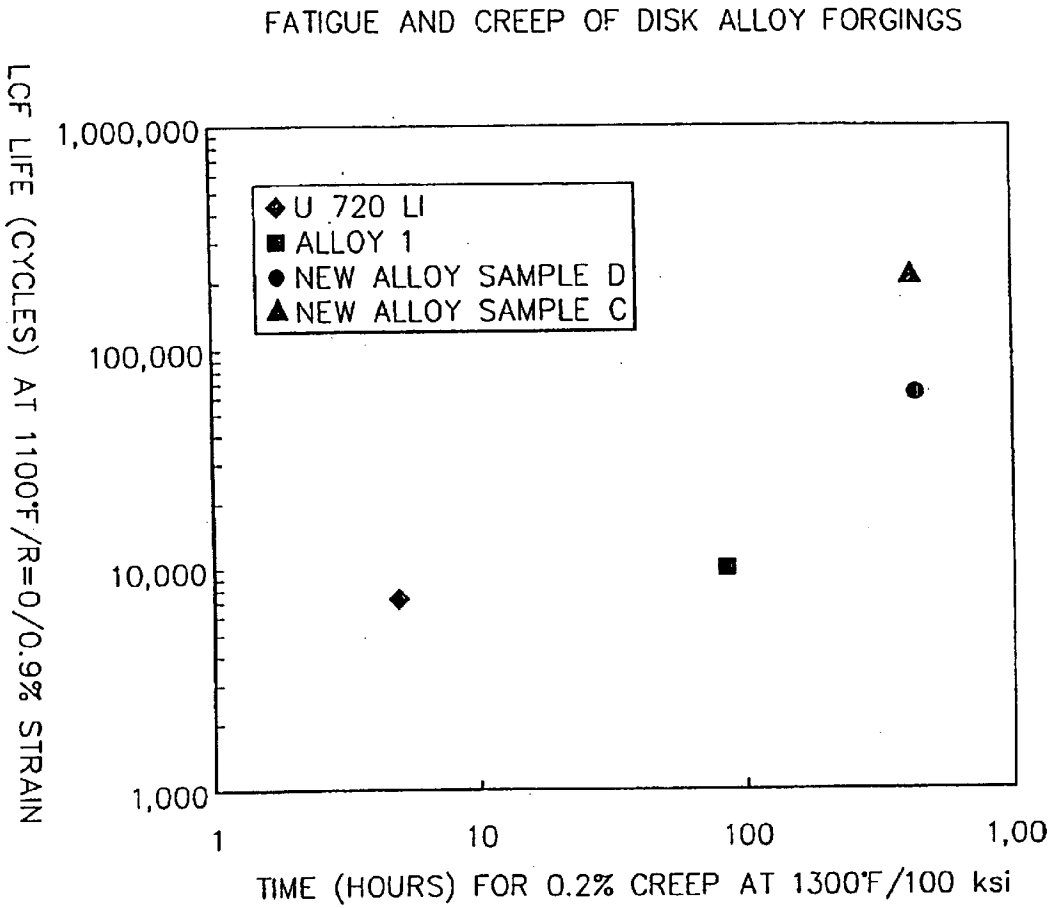
FIG. 1C is a plot showing 0.2% creep and low cycle fatigue (0.9% strain) data for alloy samples C and D of the invention and for conventional alloy U720 LI.

Data for LCF life at 1100° F., R=0, 0.9% strain for Samples C and D of the invention (Examples 5 and 6) are shown in FIG. 1C. Data for the conventional alloy, U720 LI, and for Alloy 1, tested under the same conditions, are included for comparison. It can be seen from FIG. 1C that under the specified test conditions, LCF values and time for 0.2% creep for Samples C and D are at least several fold higher than those for alloy U720 LI and Alloy 1. The data from FIGS. 1B and 1C are tabulated below (Table 2).

TABLE 2

LCF and 0.2% Creep Values for Various Superalloys

| Alloy Material | Time (hours) for 0.2% Creep (1300° F., 100 ksi) | LCF Life (cycles) (1100° F., R = 0, 0.7% strain) | LCF Life (cycles) (1100° F., R = 0, 0.9% strain) |
|---|---|---|---|
| Sample C | 432 | 472,876 | 221,776 |
| Sample D | 450 | 205,610 | 61,860 |
| U720 LI[2] | 5 | 95,911 | 7,263 |
| Alloy 1[3] | 85 | 66,550 | 9,850 |

[2]conventional superalloy;
[3]alloy of Merrick et al. (U.S. Pat. No. 6,468,368).

It should be understood, of course, that the foregoing relates to embodiments of the invention and that modifications may be made without departing from the spirit and scope of the invention as set forth in the following claims.

We claim:

1. A nickel based superalloy composition, comprising:

16.5 to 20.5 weight % Co, 9.5 to 12.5 weight % Cr, 1.8 to 3.2 weight % Mo, 4.25 to 6.0 weight % W, 3.0 to 4.2 weight % Al, 3.0 to 4.4 weight % Ti, 1.0 to 2.0 weight % Ta, 0.06 to 1.8 weight % Nb, 0.01 to 0.08 weight % C, 0.01 to 0.06 weight % B, 0.03 to 0.15 weight % Zr, and Ni, wherein a W: Ta ratio is between 2.9 and 4.1.

2. The nickel based superalloy composition of claim 1, comprising 18.2 weight % Co 11.2 weight % Cr 2.65 weight % Mo, 4.8 weight % W, 3.57 weight % Al, 3.86 weight % Ti, 1.65 weight % Ta, 0.95 weight % Nb 0.027 weight % C, 0.028 weight % B, and 0.07 weight % Zr.

3. The nickel based superalloy composition of claim 2, wherein said superalloy exhibits a LCF life, at 800° F., R=1, 0.65% strain, of greater than about 260,000 cycles.

4. The nickel based superalloy composition of claim 1, comprising: 17.8 weight % Co, 11.0 weight % Cr, 2.6 weight % Mo, 5.0 weight % W, 3.58 weight % Al, 3.9 weight % Ti, 1.47 weight % Ta, 1.03 weight % Nb, 0.028 weight % C, 0.028 weight % B, and 0.10 weight % Zr.

5. The nickel based superalloy composition of claim 4, wherein said superalloy exhibits a LCF life, at 800° F., R=−1, 0.65% strain of greater than about 260,000 cycles.

6. The nickel based superalloy composition of claim 1, comprising: 16.9 weight % Co, 11.1 weight % Cr, 2.55 weight % Mo, 5.5 weight % W, 3.79 weight % Al, 3.97 weight % Ti, 1.57 weight % Ta, 0.91 weight % Nb, 0.033 weight % C, 0.035 weight % B, and 0.09 weight % Zr.

7. The nickel based superalloy composition of claim 6, wherein said superalloy exhibits a LCF life, at 1100° F., R=0.7% strain, of greater than about 470,000 cycles.

8. The nickel based superalloy composition of claim 1 comprising: 17.4 weight % Co, 11.0 weight % Cr, 2.56 weight % Mo, 5.5 weight % W, 3.64 weight % Al, 3.8 weight % Ti, 1.47 weight % Ta, 0.94 weight % Nb, 0.03 weight % C, 0.03 weight % B, and 0.01 weight % Zr.

9. The nickel based superalloy composition of claim 8, wherein said superalloy exhibits a LCF life, at 1100° F. =0,0.7% strain, of greater than about 200,000 cycles.

10. The nickel based superalloy composition of claim 8, wherein said superalloy exhibits a 0.2% creep time, at 1300° F. and 100 ksi, of greater than about 400 hours.

11. A gas turbine engine component formed from the nickel based superalloy composition of claim 1.

12. The gas turbine engine component of claim 11, wherein said gas turbine engine component is selected from the group consisting of a compressor disk, a turbine disk, a seal plate, and a spacer.

13. The nickel based superalloy composition of claim 1, wherein said W is present from 4.25 to 5.5 weight %.

14. The nickel based superalloy composition of claim 13, wherein said W is present from a 4.25 to 5.0 weight %.

15. The nickel based superalloy composition of claim 13, wherein said W is present from 5.1 to 5.5 weight %.

16. The nickel based superalloy composition of claim 13, wherein said Nb is present from 0.80 to 1.60 weight %.

17. A turbine disk for a gas turbine engine, said turbine disk made from the superalloy composition of claim 1.

18. The nickel based superalloy composition of claim 1, comprising: 16.8 to 19.8 weight % Co, 10.0 to 12.0 weight % Cr, 2.2 to 3.0 weight % Mo, 4.25 to 5.5 weight % W, 3.3 to 3.9 weight % Al, 3.3 to 4.1 weight % Ti, 1.30 to 1.80 weight % Ta, 0.80 to 1.60% Nb, 0.02 to 0.05 weight % C, 0.02 to 0.05 weight % B, 0.05 to 0.12 weight % Zr, and Ni.

19. A gas turbine engine component comprising the nickel based superalloy composition of claim 18.

20. The nickel based superalloy composition of claim 18, comprising: 17.8 to 19.8 weight % Co, 10.0 to 12.0 weight % Cr, 2.3 to 2.9 weight % Mo, 4.25 to 5.0 weight % W, 3.3 to 3.8 weight % Al, 3.6 to 4.0 weight % Ti, 1.3 to 1.8 weight % Ta, 0.90 to 1.60 weight % Nb, 0.02 to 0.050 weight % C, 0.020 to 0.040 weight % B, 0.05 to 0.10 weight % Zr, and Ni.

21. A gas turbine engine component comprising the nickel based superalloy composition of claim 20.

22. The nickel based superalloy composition of claim 18, comprising: 16.8 to 17.2 weight % Co, 10.5 to 12.0 weight % Cr, 2.4 to 2.8 weight % Mo, 5.1 to 5.5 weight % W, 3.4 to 3.8 weight % Al, 3.6 to 4.0 weight % Ti, 1.3 to 1.7 weight % Ta, 0.80 to 1.40 weight % Nb, 0.02 to 0.05 weight % C, 0.020 to 0.040 weight % B, 0.05 to 0.10 weight % Zr, and Ni.

23. A gas turbine engine component comprising the nickel based superalloy composition of claim 22.

* * * * *

UNITED STATES PATENT AND TRADEMARK OFFICE

CERTIFICATE OF CORRECTION

PATENT NO. : 6,866,727 B1
APPLICATION NO. : 10/741979
DATED : March 15, 2005
INVENTOR(S) : Andrew F. Hieber et al.

It is certified that error appears in the above-identified patent and that said Letters Patent is hereby corrected as shown below:

Column 7, line 66, that portion of the formula reading "800° F., R=1, 0.65%" should be changed to --800° F, R = -1, 0.65 %--;

Column 8, line 7, that portion of the formula reading "800° F.," should be changed to --800° F,--;

Column 8, line 15, that portion of the formula reading "1100° F., R=0.7% strain" should be changed to --1100° F, R= 0, 0.7% strain--;

Column 8, line 19, that portion of the formula reading "0.01 weight % Zr" should be changed to --0.1 weight % Zr--;

Column 8, lines 21 and 22, that portion of the formula reading "1100° F.=0,0.7% strain" should be changed to -- 1100° F, R=0, 0.7% strain--;

Column 8, line 25, that portion of the formula reading "1300° F." should be changed to --1300° F--;

Signed and Sealed this

Twenty-ninth Day of May, 2007

JON W. DUDAS
*Director of the United States Patent and Trademark Office*